US006279583B1

(12) United States Patent
Neuner

(10) Patent No.: US 6,279,583 B1
(45) Date of Patent: Aug. 28, 2001

(54) MASCARA BRUSH WITH MULTI-LENGTH FIBERS AND METHOD OF MAKING THE SAME

(75) Inventor: Charles P. Neuner, Amityville, NY (US)

(73) Assignee: Color Access, Inc., Melville, NY (US)

( * ) Notice: Subject to any disclaimer, the term of this patent is extended or adjusted under 35 U.S.C. 154(b) by 0 days.

(21) Appl. No.: 09/458,892

(22) Filed: Dec. 10, 1999

(51) Int. Cl.[7] ..... A45D 40/26
(52) U.S. Cl. ..... 132/218; 132/313; 132/317
(58) Field of Search ..... 132/218, 313, 132/317, 320; 15/206, 160, 164, 167.3, 207

(56) References Cited

U.S. PATENT DOCUMENTS

| | | | | |
|---|---|---|---|---|
| 4,365,642 | | 12/1982 | Costa . | |
| 4,403,624 | | 9/1983 | Montgomery . | |
| 4,586,520 | * | 5/1986 | Brittain | 132/218 |
| 4,733,425 | | 3/1988 | Hartel . | |
| 4,828,420 | | 5/1989 | Otsuka et al. . | |
| 4,887,622 | | 12/1989 | Gueret . | |
| 4,898,193 | | 2/1990 | Gueret . | |
| 5,165,760 | * | 11/1992 | Gueret | 132/218 |
| 5,197,497 | * | 3/1993 | Gueret | 132/218 |
| 5,345,644 | * | 9/1994 | Gueret | 15/160 |
| 5,551,456 | | 9/1996 | Hartel . | |
| 5,595,198 | * | 1/1997 | Kemmerer | 132/218 |

FOREIGN PATENT DOCUMENTS

| | | | |
|---|---|---|---|
| 1050236 A1 | 11/2000 | (EP) | A46B/9/02 |
| 2170996 | 8/1986 | (GB) | A46B/9/02 |

* cited by examiner

*Primary Examiner*—Pedro Philogene
(74) *Attorney, Agent, or Firm*—Kenyon & Kenyon

(57) ABSTRACT

A mascara brush is disclosed that has a twisted wire core supporting a plurality of regularly disposed radially extending short and long bristles. The tips of the long bristles define an outer envelope of the brush. The short and long bristles are interspersed such that tips of the short bristles form a layer spaced inwardly from the outer envelope. The brush can be made without regard to bristle stiffness. Because the brush can be made without regard to bristle stiffness, the short bristles can have a degree of flexibility for a given length that is equal to or greater than a degree of flexibility for a given length of the long bristles. The brush is made by first forming a brush blank. The brush blank is made by providing a plurality of bristles of substantially equal length between a pair of parallel wire segments. The wire segments are initially twisted sufficiently to secure the bristles for subsequent steps. After the initial twisting, the bristles having their original lengths define the outer envelope, or the bristles may be trimmed to define the outer envelope and finish the brush blank. The short bristles are formed from a portion of the longer bristles by cutting a series of circumferentially spaced longitudinal grooves in the outer envelope of the brush blank. The wire segments are then further twisted to displace and disperse the short bristles among the long bristles such that the tips of the short bristles define a layer spaced inwardly from the tips of the long bristles.

20 Claims, 4 Drawing Sheets

MASCARA BRUSH WITH MULTI-LENGTH FIBERS AND METHOD OF MAKING THE SAME

BACKGROUND OF THE INVENTION

1. Field of the Invention

The present invention relates to a brush with bristles extending radially from a twisted wire core. More particularly, the invention concerns a cosmetic applicator brush with multi-length fibers, and method of making the brush.

2. Description of the Prior Art

Brushes having a twisted core are known, such as, for example, mascara brushes used to apply mascara to a user's eyelashes. A typical mascara brush is comprised of a core formed from a single metallic wire folded in a generally u-shaped configuration to provide a pair of parallel wire segments. Bristles (sometimes referred to as filaments or fibers), usually comprised of strands of nylon, are disposed between a portion of a length of the wire segments. The wire segments are then twisted, or rotated, to form a helical core (also known as a twisted wire core) which holds the filaments substantially at their midpoints so as to clamp them. In this way, a bristle portion or bristle head is formed with regularly disposed radially extending bristles secured in the twisted wire core in a helical or spiral manner. See, for example, U.S. Pat. No. 4,887,622 to Gueret, and U.S. Pat. No. 4,733,425 to Hartel et al.

Generally, a mascara applicator is inserted into a container having a reservoir of mascara or some other cosmetic medium. The bristles are arranged so as to pick up a supply of mascara and carry it from the container for application to a user's eyelashes. See, for example, U.S. Pat. No. 4,365,642 to Costa, U.S. Pat. No. 4,733,425 to Hartel et al., and U.S. Pat. No. 4,887,622 to Gueret.

Mascara applicators are preferred that optimize, for example, a combination of loading, application and combing characteristics. Loading refers to the mascara carrying capacity of the applicator. Brushes that maximize loading minimize the number of times a user must introduce the applicator into the reservoir to replenish the brush. Application characteristics are optimized in an applicator that applies the mascara in a uniform and attractive manner in as few strokes as possible. Combing characteristics are optimized in an applicator that properly separates the lashes and removes excess mascara to provide a finished appearance. However, a brush that maximizes loading may have application and combing characteristics that are unsatisfactory. For example, a heavily loaded brush may apply excess cosmetic to the eyelashes, thus requiring extra application or combing strokes to remove the excess. Conversely an applicator that applies product or combs lashes with minimal strokes to achieve a finished appearance may carry an insufficient load of product. Accordingly, an ideal applicator optimizes a combination of loading, application and combing characteristics, so that a finished appearance may be expeditiously accomplished in as few strokes as possible and with as few introductions of the applicator into the mascara reservoir as possible.

It is known that providing a bristle head with bristles or fibers of different lengths can improve the loading, application and combing characteristics of a mascara brush. The shorter bristles improve loading and application characteristics of the brush, while the longer bristles improve combing characteristics of the brush.

It is known that to achieve a particular brush shape, a bristle portion of a brush can be trimmed, for example, peripherally, diametrically or linearly, or in any combination of these trim modes. Brushes having bristles trimmed to different lengths are disclosed for example in U.S. Pat. No. 5,595,198 to Kemmerer and U.S. Pat. No. 5,551,456 to Hartel. The brushes disclosed in these references have portions formed from long bristles and portions formed from short bristles, but the long and short bristle lengths are not shown to be intermingled in a manner that would provide a layer inwardly spaced from the outer envelope.

U.S. Pat. No. 5,165,760 to Gueret discloses a method for making a brush comprising shorter stiff bristles and longer soft bristles. The brush is initially made from stiff bristles and soft bristles of the same length. During a grinding operation, the stiff bristles are said to be reduced in length to become the shorter bristles, while the soft bristles are said to deflect sufficiently to avoid the grinder, and remain long. A problem with this method is that pre-determining the length of the long and short bristles with respect to each other relies on the difference in stiffness between the stiff and soft bristles. Accordingly, bristles with a difference in degree of stiffness selected to yield a desired bristle length differential may not exhibit ideal brush characteristics, e.g., combing, loading, application, etc. Conversely, bristles that exhibit ideal brush characteristics may not have a sufficient difference in degree of stiffness to yield a optimal bristle length differential. Furthermore, with the disclosed method, it is not possible to make a brush with short soft bristles interspersed with long stiff bristles, and it is not possible to make a brush with long bristles interspersed with short bristles wherein all of the bristles have a uniform stiffness. These latter two bristle arrangements should yield a more desirable applicator since longer, stiff bristles are believed to provide better combing characteristics, and shorter, soft bristles are thought to provide better application characteristics.

It is believed that an ideal arrangement would have "layered" bristle lengths, i.e., bristles would be intermingled such that the tips of bristles having a first length form an outer envelope, and the tips of bristles having a second shorter length form a layer spaced inwardly from the outer envelope. Accordingly, there is a need for a brush having long and short bristle lengths interspersed such that the tips of the short bristles form a layer spaced inwardly from the tips of the long bristles, wherein the brush can be made in an simple manner, without regard to bristle stiffness.

BRIEF SUMMARY OF THE INVENTION

Disclosed is a brush having bristle lengths precisely layered without regard to bristle stiffness, and a method of making the same. The brush has a twisted wire core supporting a plurality of regularly disposed radially extending long and short bristles. The tips of the long bristles define an outer envelope of the brush. The tips of the short bristles are regularly disposed among the long bristles and define a layer spaced inwardly from the outer envelope. Because the brush can be made without regard to bristle stiffness, the short bristles can have a degree of flexibility for a given length that is equal to or greater than a degree of flexibility for a given length of the long bristles.

The brush is made by first forming a brush blank. The brush blank is formed by providing a plurality of bristles between a pair of parallel wire segments, and initially twisting the wire segments sufficiently to secure the bristles for subsequent steps. After the initial twisting, the bristles having their original length define the outer envelope, or the bristles may be trimmed to define the outer envelope. The short bristles are formed from a portion of the longer bristles by cutting a series of circumferentially spaced longitudinally directed grooves in the outer envelope. The wire segments are then further twisted to displace the short bristles from the grooves to positions among the long bristles while long bristles are displaced into the grooves, such that the tips of the short bristles define a layer spaced inwardly from the tips of the long bristles. Preferably, the wire segments are further twisted until the outer envelope is free of apparent grooves.

BRIEF DESCRIPTION OF THE DRAWINGS

FIG. 12*a* is a schematic representation of the cross-section of the alternative embodiment shown in FIG. 12; and.

DETAILED DESCRIPTION OF THE PREFERRED EMBODIMENTS

Figure 1:
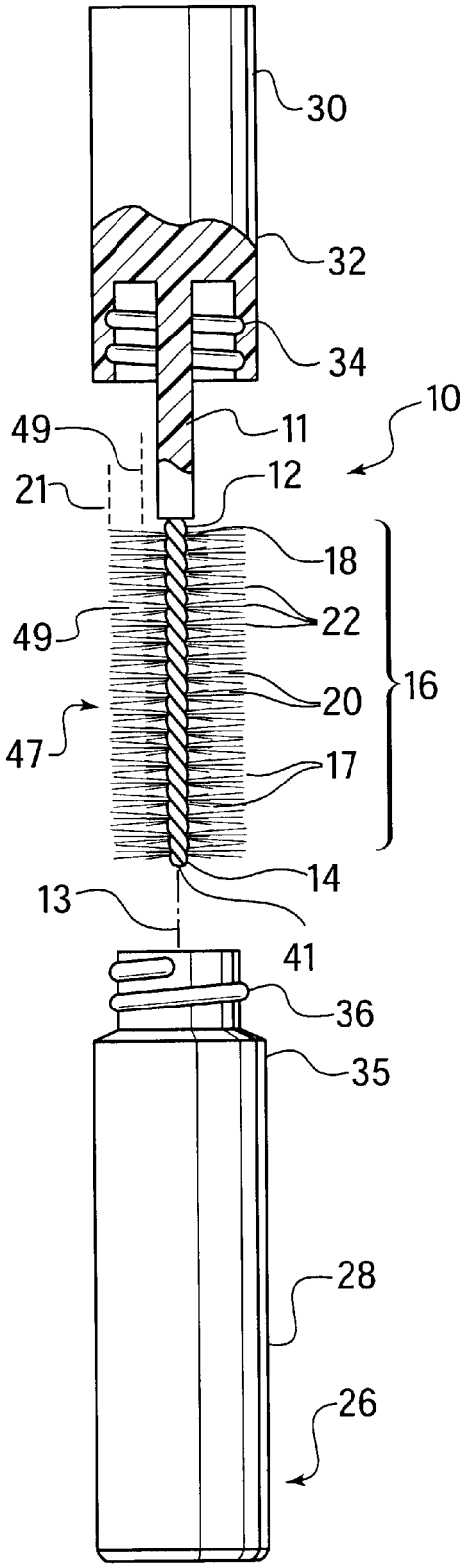
FIG. 1 is a side view in partial cross-section of a mascara brush in accordance with the present invention, and a container.

Referring now to FIG. 1, a mascara applicator brush, designated generally by reference numeral 10, is shown as part of a mascara package including a container 26 and cap 30. The container 26 may be of a known type having a peripheral wall 28 defining a product storage chamber sized to receive the brush 10. The cap 30 may also be of a known type. The cap 30 has a lower end 32 sized to be received on an upper end 35 of the container 26 in cooperative engagement by way of complementary threads 34 and 36 on the cap 30 and on the container 26, respectively.

Figure 2:
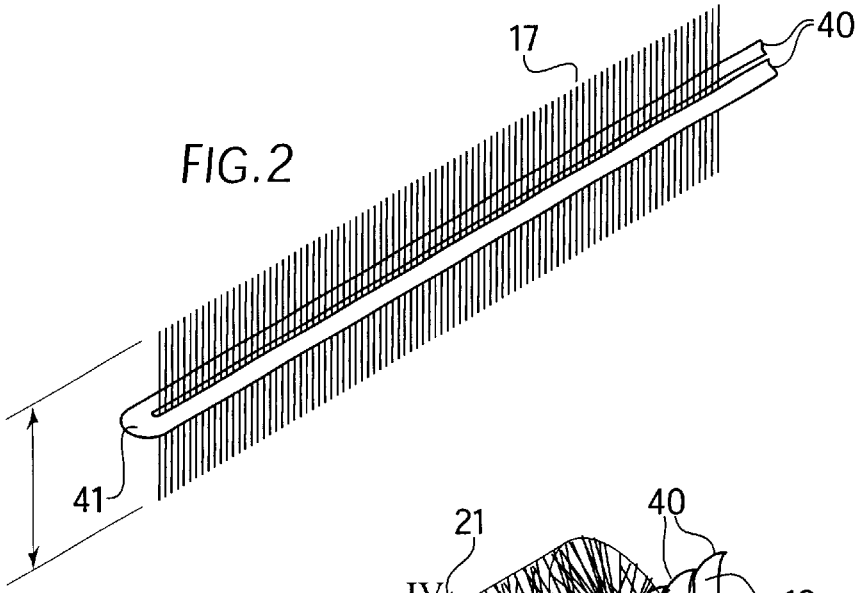
FIG. 2 is a perspective view of a step in the process of making a brush of the type embodying the invention.
Figure 3:
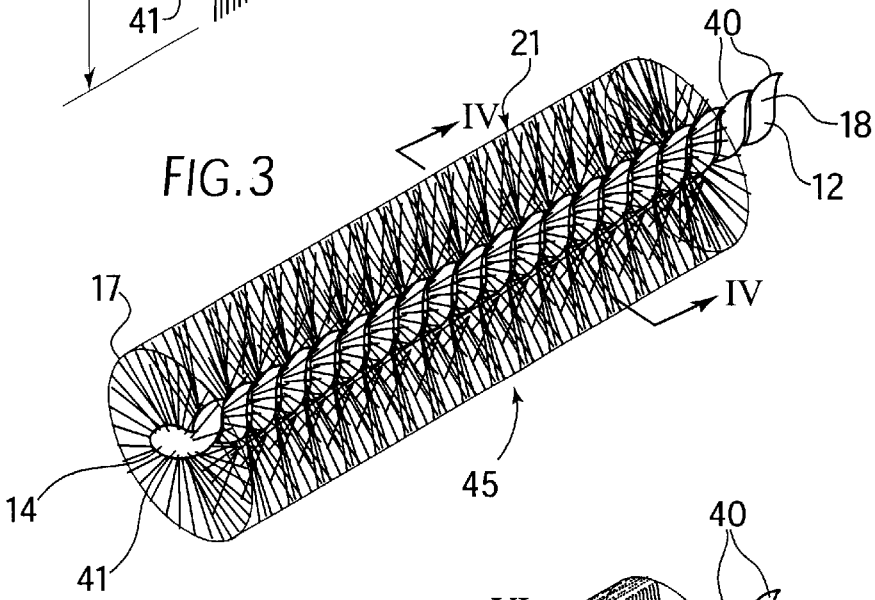
FIG. 3 is a perspective view of a further step in the process of making a brush of the type embodying the invention.
Figure 7:
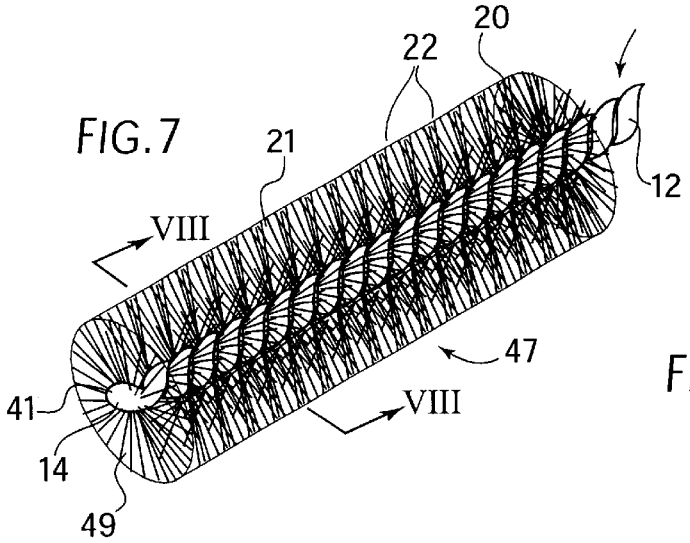
FIG. 7 is a perspective view of a preferred embodiment of the present invention.
Figure 8:
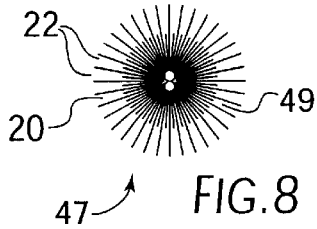
FIG. 8 is a cross-sectional view of the preferred embodiment of the present invention taken along line 8—8 of FIG. 7.
Figure 11:
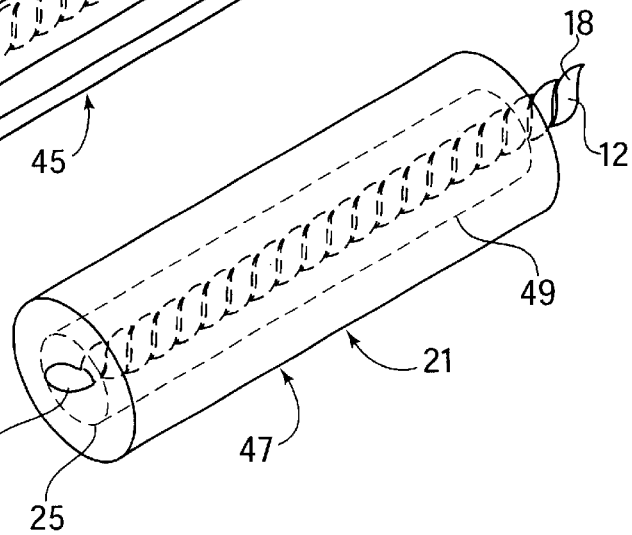
FIG. 11 is a schematic perspective view of the bristle envelope of the preferred embodiment shown in FIGS. 7–8, i.e., an outer envelope free of grooves with an inner layer of shorter bristles shown by broken lines.

The brush 10 is comprised of a central core 12 having a first or proximal end 18 connected to the cap 30, and a second or distal end 14 opposite the proximal end 18. A longitudinal axis 13 is defined along the core 12 through the proximal and distal ends, 18 and 14, respectively. In FIG. 1, the proximal end 18 of the core 12 is connected to the cap 30 by way of a shaft 11, however, the proximal end 18 of the core 12 could be attached directly to the lower end 32 of the cap 30. A bristle portion 16 extends along at least part of the length of the core 12 from the distal end 14 toward the proximal end 18. The bristle portion 16 is comprised of regularly disposed, radially extending bristles 17 attached to the core 12. The bristles 17 preferably have at least two lengths. As can best be seen in FIGS. 1, 7, 8 and 11, long bristles 22 define an outer envelope 21 of the bristle portion 16. Short bristles 20 define a layer 25 spaced inwardly from the outer envelope 21 (FIGS. 7, 8 and 11). Preferably the core 12 is a twisted wire core, i.e., a pair of parallel wire segments 40 (FIG. 2) connected at one end 41 and twisted about the longitudinal axis of the core to secure the bristles 17 between the wire segments 40 (FIGS. 1, 3, 5 and 7). Although a twisted wire core is preferred, it will be understood that the present invention is suitable for use with any core that can be twisted about the longitudinal axis to fixedly displace bristles from a first distribution to a second distribution.

Figure 4:
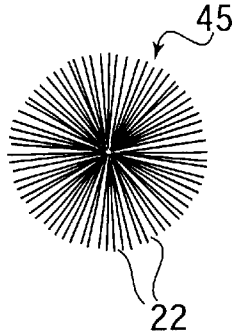
FIG. 4 is a cross-sectional view of the brush head taken along line 4—4 of FIG. 3.
Figure 9:
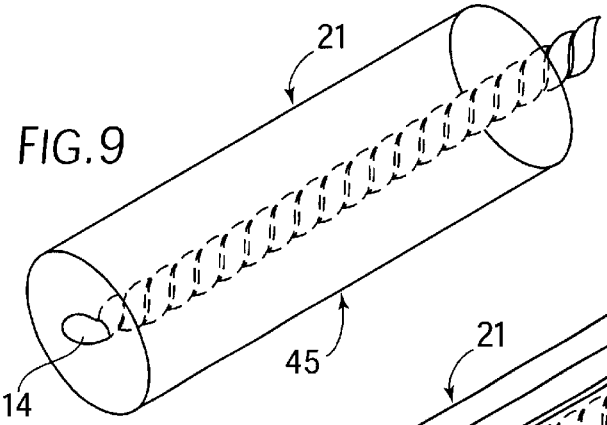
FIG. 9 is a schematic perspective view of the bristle envelope of the brush head depicted in FIGS. 3 and 4, i.e., a brush of the type embodying the present invention.

In the preferred embodiment, the brush 10 is formed by a method that first involves forming a brush blank 45 (FIGS. 3, 4 and 9) by introducing a plurality of bristles 17 between a pair of parallel wire segments 40 (FIG. 2) and initially twisting the wire segments 40 to secure the plurality of bristles 17 for subsequent steps. Preferably, this step of initially twisting the wire segments will take the wire segments to a degree of twist which is 50%–75% of the degree of twist achieved in the final brush, as explained in greater detail below. The bristles 17 are secured at approximately their mid-point between the wire segments 40 such that tips of the plurality of bristles have a first length that defines an outer envelope 21 (see FIGS. 3, 4 and 9). For illustrative purposes, the outer envelope 21 is depicted schematically in FIGS. 9–11. Preferably, the bristles are trimmed after the initial twisting step to a selected uniform length. The bristles may also be trimmed to provide a particular shape to the outer envelope, such as, for example, a football or hourglass shape (not shown).

Figure 5:
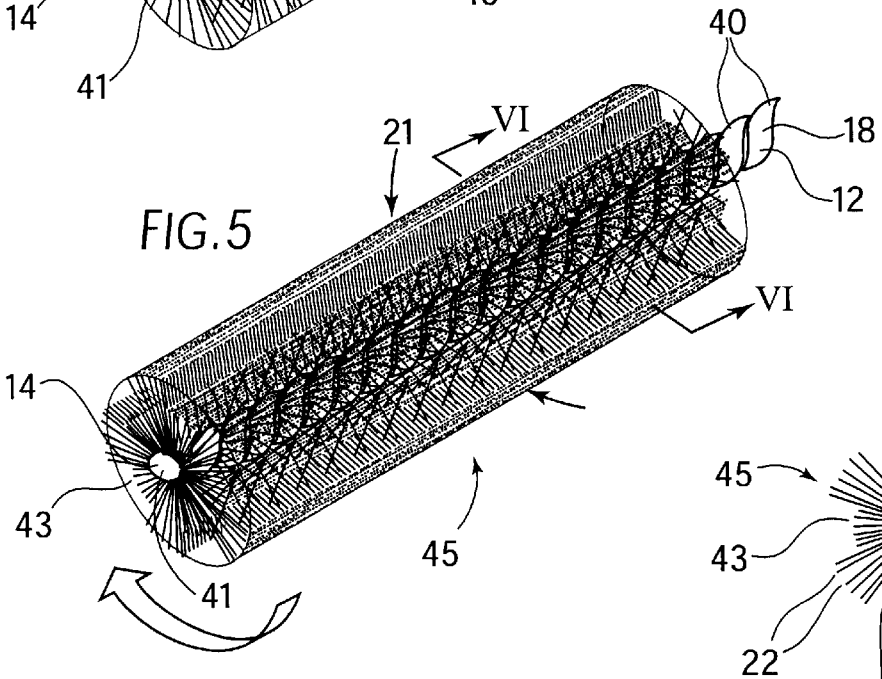
FIG. 5 is a perspective view of a further step in the process of making the brush of the present invention wherein short bristles have been formed by cutting grooves in the bristle envelope.
Figure 6:
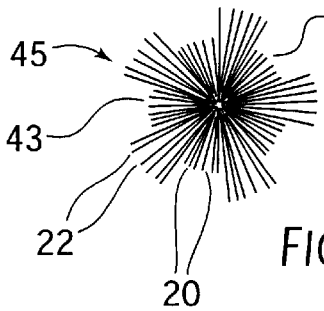
FIG. 6 is a cross-sectional view of the brush head taken along line 6—6 of FIG. 5.
Figure 10:
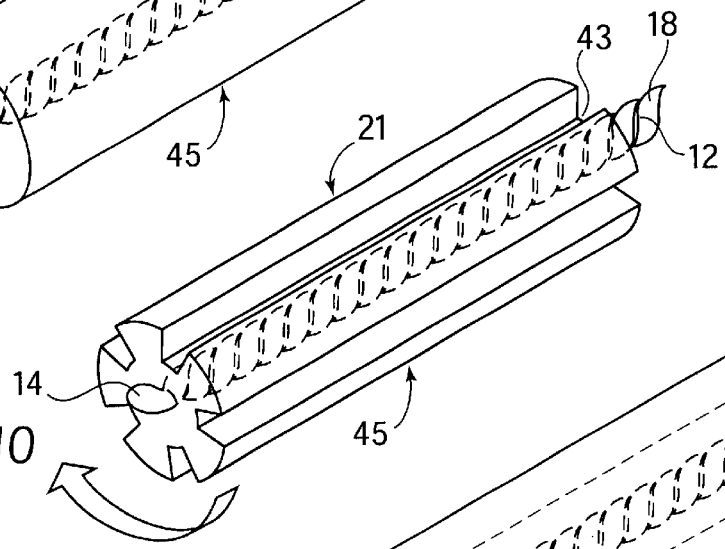
FIG. 10 is a schematic perspective view of the bristle envelope of the brush head depicted in FIGS. 5 and 6, i.e., a bristle envelope of a brush blank with grooves cut to form short bristles.

Next, shortened bristles 20 are formed from a portion of the plurality of bristles 17 by removing length from each of the bristles of that portion by known methods and means, such as, for example, by cutting, grinding, etc. One method of removing length from a portion of the bristles involves cutting or grinding at least one generally longitudinally directed groove 43 in the outer envelope 21 as shown in FIGS. 5, 6 and 10. Subsequent to the step of initially twisting the wire core to form the brush blank and subsequent to forming the short bristles 20 on the brush blank 45, the core 12 of the brush blank 45 is further twisted (or merely twisted if the core of the brush blank is not initially a twisted core) in one or more steps. The core 12 is further twisted sufficiently to cause at least some of the short bristles 20 to intermingle with the long bristles 22 such that tips of the short bristles 20 form an inner layer 49 spaced inwardly from the tips of the long bristles 22. The core is twisted until the desired inner layer 49 is achieved, i.e., until a final brush configuration 47 is achieved such as, for example, that shown in FIGS. 1, 7, 8 and 11.

The preferred final brush configuration 47, shown in FIGS. 1, 7, 8 and 11, has a generally cylindrical outer envelope 21 free of grooves and a generally cylindrical inner layer 49 that is substantially uniform in radial cross-section.

This particular configuration is achieved by cutting a plurality of longitudinally directed grooves 43 in the outer envelope 21 spaced about the circumference of the radial cross-section (see FIGS. 5, 6 and 10). In the preferred embodiment, the grooves are dimensioned and spaced such that, subsequent to cutting the grooves, and subsequent to the final twisting operation, the grooves are no longer apparent, i.e., the cylindrical outer envelope 21 and the inner layer 49 are substantially free of grooves as shown in FIGS. 1, 7, 8 and 11. It will also be clear from the description and the drawings that the length of the short bristles 20 will determine the height of the inner layer 49 relative to the core 12 and/or the outer envelope 21.

Figure 13:
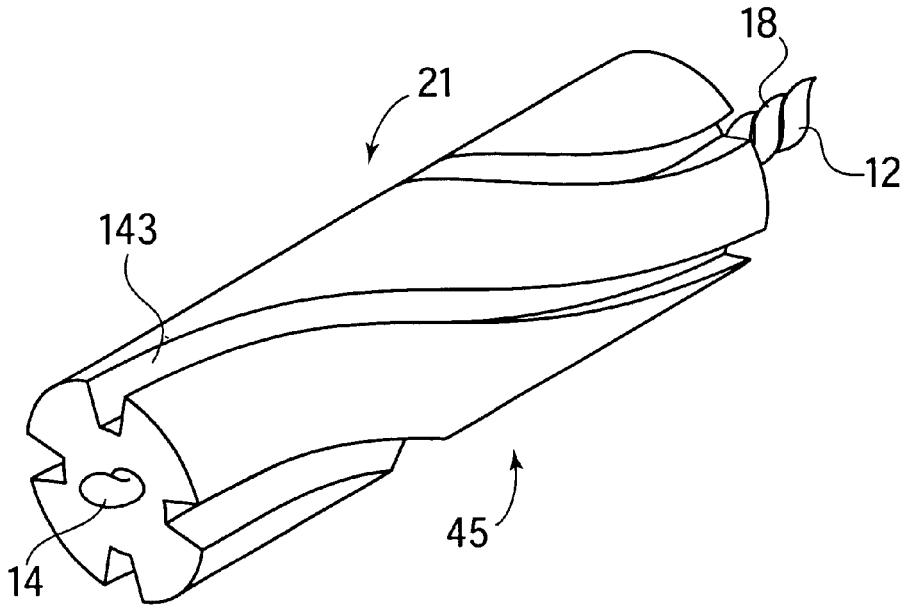
FIGS. 13–14 are schematic perspective views of a bristle envelope of a brush blank with grooves cut to form short bristles, the grooves having alternative configurations.
Figure 14:
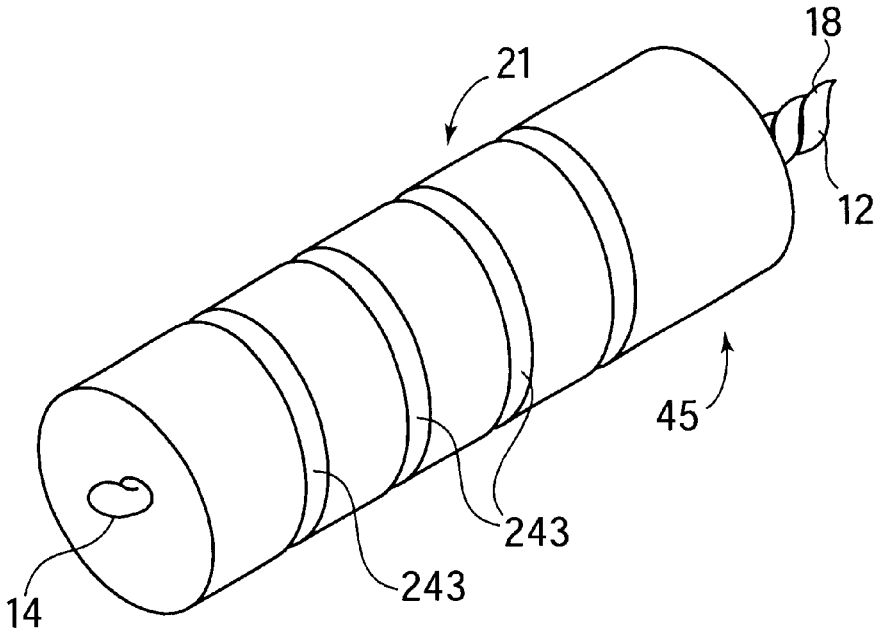

Although in the method of making the preferred embodiment, the grooves are cut generally "along the longitudinal axis" of the brush blank 45, this is intended to include grooves 43 cut parallel to the longitudinal axis (FIG. 10) or grooves 143 cut helically about the longitudinal axis (FIG. 13). Alternatively, or in addition to the generally longitudinal groove, a groove or grooves 243 may be cut annularly about the brush blank 45 (FIG. 14) to vary the layering effect within the brush head. It should also be apparent that the short bristles can be formed by methods other than cutting grooves, i.e., by cutting any type of clearance in the surface of the outer envelope 21. After forming the short bristles, the core must be further twisted sufficiently to intersperse at least some of the short and long bristles to yield at least one layer defined by the tips of short bristles spaced inwardly from the outer envelope defined by long bristles.

In the preferred embodiment, the plurality of circumferentially spaced grooves 43 are all of equal depth, so that the short bristles 20 each have substantially the same length and a single inner layer 49 is defined. Alternatively, short bristles having more than one length may be formed such that more than one inwardly spaced layer is defined in the brush head. The short bristles having more than one length can be formed in groups of uniform length by cutting one groove to a first depth and a second groove to a second depth. Subsequent twisting to a sufficient degree will yield a brush with more than one inner layer of bristles. Alternatively, the short bristles having more than one length can be formed by cutting a groove with a depth varying incrementally across the width of the groove. The depth of a groove can also be varied along the length to provide a layer that varies along the length of the brush.

Figure 12:
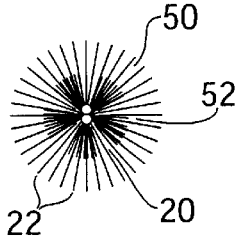
FIG. 12 is a cross-sectional view of an alternative embodiment of the present invention.
Figure 12A:
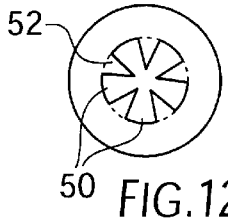

The twisting step after forming the shortened bristles may also be varied to achieve a desired outcome. As noted above, the step of twisting the core after formation of the short bristles 20 should be sufficient to intersperse the short bristles 20 uniformly among the long bristles 22. In the preferred method of making the brush, the step of forming the brush blank will involve twisting the wire segments to an initial degree of twist which is 50%–75% of the final degree of twist achieved in one or more steps of further twisting the wire segments necessary to yield the final brush configuration shown in FIGS. 1, 7, 8 and 11. The preferred arrangement has a substantially cylindrical outer envelope 21 that is free of grooves, and a substantially cylindrical inner layer 49 that is free of discontinuities. However, by limiting the step of further twisting the core, the arrangement could have, for example, partial grooves in the outer envelope, or groove-like discontinuities 52 in the inner layer (FIGS. 12–12A). Whatever the final arrangement of the outer envelope and the inner layer, it is important that the tips of at least some of the short bristles 20 define a layer spaced inwardly from the outer envelope, even if that layer is defined through only a part of a radial section of the brush (FIG. 12).

It will be understood that a brush having any combination of the above variables can be made to provide particular characteristics to the applicator by selecting the dimensions and placement of the grooves 43, and by selecting the degree of further twisting of the core 12. As shown in FIG. 12, the core 12 may be twisted only sufficiently to intersperse the short bristles 20 with the long bristles 22 such that the short bristles form a configuration with a star-like radial section, i.e., a discontinuous or segmented inner layer 50 is formed. The segments of the inner layer 50 are separated by groove-like discontinuities 52. This same radial cross section can be achieved by carefully selecting the dimensions of the grooves 43 relative to the intervening uncut portions of the bristles. For example, to yield a non-cylindrical configuration of short bristles within a cylindrical arrangement of long bristles, the grooves 43 may be cut to a width substantially narrower than intervening uncut portions of the long bristles. The step of further twisting is then conducted sufficiently to provide, for example, the arrangement of short bristles having a star-like radial cross-section shown in FIG. 12. The various bristle arrangements can be formed to have grooves or ridges that run substantially parallel to the longitudinal axis of the core. To accomplish this objective, the grooves 43 or clearances may be cut along a helical path that is selected to null out certain effects of the further twisting step. For example, in connection with the star-like configuration shown in FIG. 12, the segments of layer 50 can be formed to run parallel to the longitudinal axis by cutting grooves 43 along a helical path about the outer envelope before the core is subjected to the further step of twisting. In other words, while the groove forming the short bristles is cut along a helical path, the resulting segments of the discontinuous inner layer 50 are parallel to the longitudinal axis by virtue of the corresponding movement of the short and long bristles during the step of further twisting. Other combinations of groove dimensions and degree of twist are contemplated by the inventors.

The foregoing methods will yield a brush having a twisted wire core 12 defining a longitudinal axis 13 and supporting a bristle portion 16 at a distal end 14. The bristle portion will have regularly disposed, radially extending long and short bristles, 22 and 20 respectively. Tips of the long bristles 22 define an outer envelope 21, and tips of the short bristles 20 define at least one layer 49 spaced inwardly from the outer envelope 21. The bristle portion 16 is made by forming a brush blank 45. The brush blank 45 is formed by introducing a plurality of bristles 17 between a pair of parallel wire segments 40 and initially twisting the wire segments 40 to secure the plurality of bristles 17 for subsequent steps. The bristles 17 are secured such that tips of the plurality of bristles define the outer envelope 21. The short bristles 20 are formed from a portion of the plurality of bristles 17 by cutting at least one groove 43 in the outer envelope 21 along the longitudinal axis 13. The core 12 is further twisted to substantially eliminate the at least one groove 43 in the outer envelope 21, thus yielding an outer envelope free of apparent grooves. In the preferred embodiment, the at least one groove is a plurality of grooves 43 spaced about the radial circumference of the bristle portion, and the step of further twisting the core substantially eliminates all of the grooves in the outer envelope.

It will be clear from the present disclosure that a mascara brush can be made that has a plurality of regularly disposed radially extending short and long bristles secured to the core, wherein each of the plurality of bristles has substantially the same degree of flexibility for a given length, and wherein the long bristles define an outer envelope and the short bristles define a layer spaced inwardly from the outer envelope.

While the invention has been described and illustrated as embodied in preferred forms of construction, it will be understood that various modifications may be made in the structure and arrangement of the parts without departing from the spirit and the scope of the invention recited in the following claims.

What is claimed is:

1. A method for making a brush having a core defining a longitudinal axis, the core supporting a bristle portion with radially extending bristles, the method comprising:

forming a brush blank by introducing a plurality of bristles between a pair of parallel wire segments and initially twisting the wire segments to form the core and to secure the plurality of bristles for subsequent steps such that the plurality of bristles have a first length defining an outer envelope;

forming shortened bristles from a portion of the plurality of bristles by cutting at least one groove in the outer envelope; and further twisting the wire segments to intersperse at least some of said shortened bristles among bristles having said first length such that tips of said interspersed shortened bristles define at least one layer spaced inwardly from the outer envelope.

2. The method of claim 1 wherein the at least one groove is cut in the outer envelope along the longitudinal axis.

3. The method of claim 1 wherein the step of further twisting is sufficient to eliminate said at least one groove from said outer envelope.

4. The method of claim 1 wherein said at least one groove is a plurality of grooves in the outer envelope each directed along the longitudinal axis and spaced about a circumference of a radial cross-section of the outer envelope, and the step of further twisting the wire segments is sufficient to eliminate said plurality of grooves from said outer envelope.

5. The method of claim 1 wherein the step of forming the brush blank further comprises twisting the wire segments to an initial degree of twist which is 50%–75% of a final degree of twist achieved in the step of further twisting the wire segments.

6. The method of claim 1 wherein the shortened bristles have more than one length such that more than one inwardly spaced layer is defined.

7. The method of claim 6 wherein the shortened bristles having more than one length are formed by cutting the at least one groove to a first depth and a second groove to a second depth.

8. The method of claim 6 wherein the at least one groove has a width, a depth and a length, and the shortened bristles having more than one length are formed by varying at least one of the depth across the width and the depth along the length.

9. The method of claim 1 wherein the two wire segments form at least a portion of a single length of wire connected by a unshaped bend.

10. A method for making a brush having a core defining a longitudinal axis, the core supporting a bristle portion with radially extending bristles, the method comprising:

forming a brush blank by introducing a plurality of bristles between a pair of parallel wire segments and initially twisting the wire segments to form the core and to secure the plurality of bristles for subsequent steps;

trimming the plurality of bristles to a first length defining an outer envelope;

forming shortened bristles from a portion of the plurality of bristles by cutting at least one groove in the outer envelope; and further twisting the wire segments to intersperse at least some of the shortened bristles among bristles having the first length such that tips of the interspersed shortened bristles define at least one layer spaced inwardly from the outer envelope.

11. The method of claim 10 wherein the at least one groove is cut in the outer envelope along the longitudinal axis.

12. The method of claim 10 wherein the step of further twisting is sufficient to eliminate said at least one groove from said outer envelope.

13. The method of claim 10 wherein said at least one groove is a plurality of grooves in the outer envelope each directed along the longitudinal axis and spaced about a circumference of a radial cross-section of the outer envelope, and the step of further twisting the wire segments is sufficient to eliminate said plurality of grooves from said outer envelope.

14. The method of claim 10 wherein the step of forming the brush blank further comprises twisting the wire segments to an initial degree of twist which is 50%–75% of a final degree of twist achieved in the step of further twisting the wire segments.

15. The method of claim 10 wherein the shortened bristles have more than one length such that more than one inwardly spaced layer is defined.

16. The method of claim 15 wherein the shortened bristles having more than one length are formed by cutting the at least one groove to a first depth and a second groove to a second depth.

17. The method of claim 15 wherein the at least one groove has a width, a depth and a length, and the shortened bristles having more than one length are formed by varying at least one of the depth across the width and the depth along the length.

18. A brush for applying mascara to eyelashes, comprising:

a central core defining a longitudinal axis, the central core formed from a pair of twisted wire segments;

a brush portion at an end of the core, the brush portion comprising a plurality of radially extending bristles secured between the pair of twisted wire segments of the core, a first portion of the plurality of bristles having a length defining an outer envelope of the brush portion, a second portion of the plurality of bristles disposed among the first portion, each of the second portion having a length removed such that tips of the second portion define a layer spaced inwardly from the outer envelope, and each of the second portion having a degree of flexibility for a given length that is equal to or greater than a degree of flexibility for a given length of each of the first portion.

19. The brush of claim 18 wherein the shortened bristles have more than one length such that more than one inwardly spaced layer is defined.

20. A method for making a brush having a core defining a longitudinal axis, the core supporting a bristle portion with radially extending bristles, the method comprising:

forming a brush blank by securing a plurality of bristles to a core for subsequent steps such that the plurality of bristles have a first length defining an outer envelope, the core twistable about the longitudinal axis to fixedly displace at least some of the plurality bristles from a first distribution to a second distribution;

forming shortened bristles from a portion of the plurality of bristles by cutting at least one groove in the outer envelope along the longitudinal axis; and twisting the core to intersperse at least some of said shortened bristles among bristles having said first length such that tips of said interspersed shortened bristles define at least one layer spaced inwardly from the outer envelope.

* * * * *